United States Patent [19]

Ketterer

[11] 4,232,618

[45] Nov. 11, 1980

[54] BOBBIN WINDER ARRANGEMENT FOR SEWING MACHINE LOOPTAKER

[75] Inventor: Stanley J. Ketterer, Jamesburg, N.J.

[73] Assignee: The Singer Company, Stamford, Conn.

[21] Appl. No.: 58,232

[22] Filed: Jul. 16, 1979

[51] Int. Cl.[3] ..... D05B 57/08; D05B 59/00

[52] U.S. Cl. ..... 112/184; 112/231

[58] Field of Search ..... 112/168, 181, 182, 184, 112/186, 191, 228, 232, 279, 229, 231

[56] References Cited

U.S. PATENT DOCUMENTS

| | | | |
|---|---|---|---|
| 2,056,829 | 10/1936 | Colegrove et al. | 112/279 |
| 2,394,369 | 2/1946 | Colegrove | 112/228 |
| 3,154,035 | 10/1964 | Edwards et al. | 112/184 |
| 3,693,565 | 9/1972 | Ketterer | 112/184 |
| 3,693,566 | 9/1972 | Ketterer | 112/184 |
| 4,091,755 | 5/1978 | Ishikawa et al. | 112/279 |

*Primary Examiner*—Wm. Carter Reynolds

*Attorney, Agent, or Firm*—Elliot A. Lackenbach; Robert E. Smith; E. L. Bell

[57] ABSTRACT

In a lockstitch sewing machine, a bobbin thread replenishing mechanism for selectively rotating the bobbin to wind replenishment thread thereon from a needle by means of a spindle selectively engaging the bobbin for rotating the bobbin with the machine looptaker wherein a slip clutch provided with an elongated slot is positioned around a flattened end portion of the spindle generally within a central aperture of a bobbin thread control cam. The slip clutch has an enlarged lower flange which rests on the looptaker base and rubs against the thread control cam so that by this arrangement the spindle will be driven with the looptaker by way of friction coupling of the slip clutch between the looptaker and the thread control cam. Should sufficient resistance of the turning of the spindle arise, the looptaker and thread control cam turn freely relative the slip clutch thereby preventing overwinding of the bobbin.

3 Claims, 4 Drawing Figures

BOBBIN WINDER ARRANGEMENT FOR SEWING MACHINE LOOPTAKER

DESCRIPTION

BACKGROUND OF THE INVENTION

This invention relates to a lockstitch sewing machine rotating looptaker and, more particularly, to a bobbin winding arrangement for such a looptaker.

A lockstitch is formed by concatenation of an upper or needle thread with a lower or bobbin thread. A looptaker is provided to pick up a loop of the needle thread carried through the work material by the sewing needle, enlarge the loop and cast it about a thread carrying bobbin supported internally of the looptaker. A sewing machine take-up lever is provided for the needle thread, to supply the needle thread required for the enlarged loop, and to take up the excess needle thread when the loop has been cast about the bobbin. When the excess needle thread is taken up by the take-up lever, it carries with it a bobbin thread, about which it is now looped. In subsequent stitches, the bobbin thread extends from the stitching to the bobbin and the needle thread loop must pull against the bobbin thread to be drawn, by the take-up lever, to the work material. As the needle thread loop about the bobbin thread becomes smaller, there is greater resistance to relative movement of the threads, a condition which becomes more severe as machine speed is increased. Even at constant machine speed, this condition creates a difficulty in making uniformly set stitches, the difficulty being compounded by zig zag or pattern stitching where thread demans is increased.

In the prior art, this condition has been alleviated by providing means for pulling off bobbin thread from the bobbin to, in theory, remove bobbin inertia and thread tension as a factor in the thread lock-up, thereby permitting easier flow of the bobbin thread. Some prior art machines with bobbin thread lead directly below a feed dog have accomplished this by utilizing part of the feed dog return motion to pull off bobbin thread from the bobbin requiring, however, extra mechanism or other design restraints. In U.S. Pat. No. 3,693,565, there is disclosed a lockstitch looptaker with bobbin thread lead beneath the bobbin case, between the bobbin case and the looptaker body, wherein frictional surfaces on the looptaker body periodically engage with the bobbin thread to perform a pull off function. It is also known to provide a looptaker having a portion thereof contoured in a fashion to provide a positive pull off for bobbin thread and also biasing the bobbin thread leas to one side of the sewing needle path to prevent half hitching.

In U.S. Pat. No. 3,693,566, there is disclosed a bobbin winding mechanism for winding bobbin thread from the needle. A drive spindle extends from the looptaker to the looptaker drive gear where two clutches are used for driving the bobbin spindle for winding bobbin thread from the needle when the machine operator selects a bobbin winding mode. In this mode, the spindle is raised to engage the bobbin and a positive drive connection is established between the lower end of the spindle and a gear connected with the looptaker shaft. A second, slip clutch is also provided to allow slippage and prevent over winding of the bobbin.

What would be more desirable is a method and system that is more simple and compact and which drives the spindle directly from the looptaker without being inherently complicated or expensive.

SUMMARY OF THE INVENTION

The above desired ends are achieved in accordance with the present invention by providing a slip clutch between the bobbin thread control cam and the looptaker body that also engages the bobbin winding spindle, so that the spindle rotates continuously with the looptaker and need only be raised to engage the bobbin for bobbin winding. The slip clutch then prevents overwinding of the bobbin.

DETAILED DESCRIPTION OF THE DRAWINGS

With the above and additional objects and advantages in view, as will hereinafter appear, this invention will now be described with reference to the accompanying drawing of a preferred embodiment in which.

Figure 3:
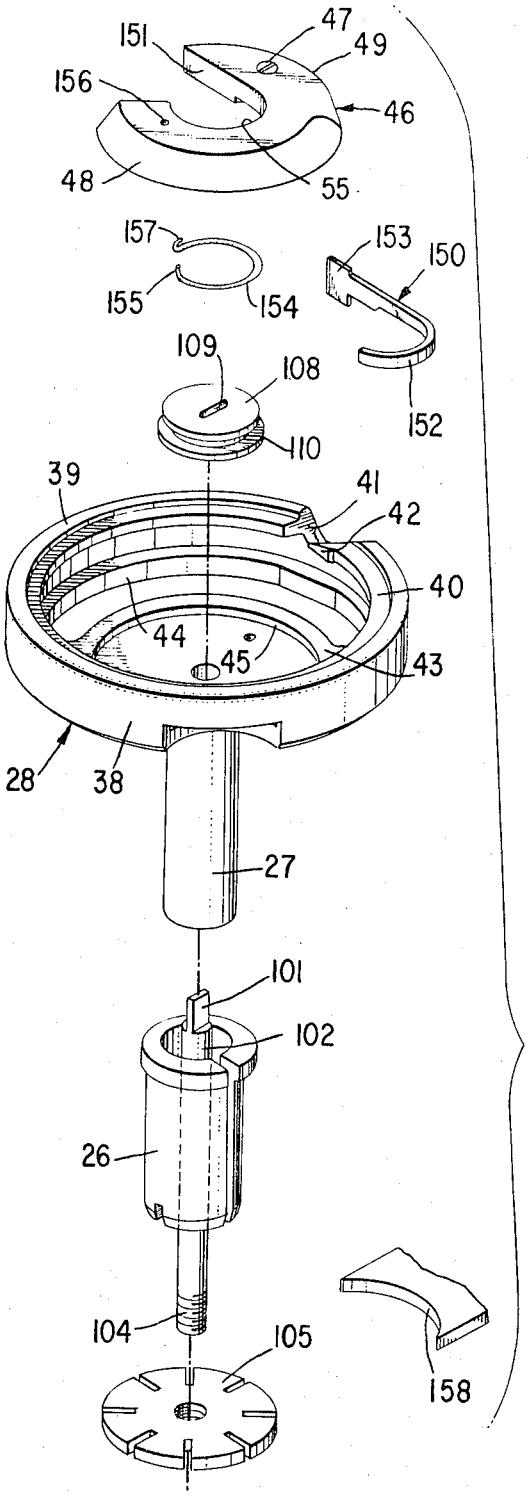
Figure 4:
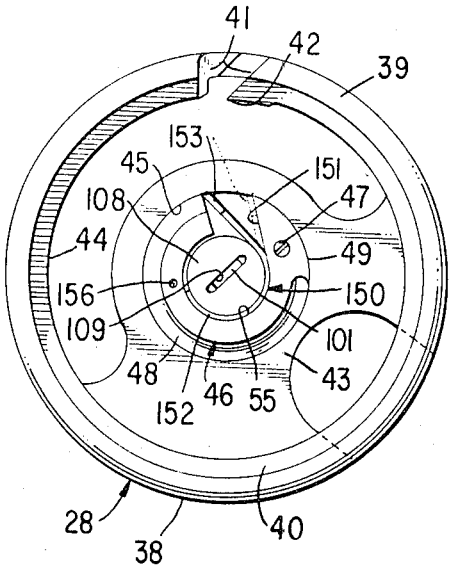

FIG. 3 is a disassembled perspective view of the looptaker, looptaker drive, bobbin thread pull-off, and the bobbin winding driver of the present invention; and FIG. 4 is a top plan view of the assembled looptaker and bobbin thread pull-off showing, in solid lines, the pull-off in the straight stitch position and showing in phantom lines, the pull-off in the zig zag position, and illustrating how the slip clutch and bobbin winding spindle rotate generally continuously with the looptaker.

DETAILED DESCRIPTION OF THE INVENTION

The apparatus illustrated in the drawing is adapted for use with a sewing machine such as is disclosed in the U.S. Pat. No. 2,862,468, Dec. 2, 1958, of R. E. Johnson which is hereby incorporated by reference and made a part of this application. The above cited patent may be referred to for disclosure of all the sewing machine mechanism save for details of the looptaker and mechanism directly related with looptaker such as the bobbin thread replenishing and bobbin thread pull-off and retraction mechanism of the present invention, which later mechanism is described in my copending application cited in more detail hereinafter.

The invention, in which the illustrated exemplary embodiment of the invention is incorporated, utilizes a vertical axis rotary looptaker, rotating in a 2 to 1 ratio with needle bar reciprocations, i.e., two rotations of the looptaker occur for each endwise reciprocation of the needle bar. There is supported in the looptaker, against rotation therewith, a bobbin case carrying a bobbin. Thread from the bobbin is passed through a bobbin thread tension means affixed to the bobbin case and passes from the tension means beneath the bobbin case to the stitching point on the side of the bobbin case opposite the bobbin thread tension means. The side of the bobbin case opposite the bobbin thread tension means extends deeper into the looptaker in order to force the bobbin thread to extend into the path of the bobbin thread pull-off cam and, in one embodiment of a shiftable element thereof carried on the looptaker body, so that the fixed cam portion will act on the bobbin thread well after the previous stitch has been set to provide a set pull-off action while the shiftable element with its changing timing will provide variable retraction. After the previous stitch has been set, the edge of the pull-off cam contacts the bobbin thread extending between the previous stitch and the bobbin tension supported on the bobbin case; and, as the rotation of the looptaker continues, pulls a supply of bobbin thread from the bobbin through the bobbin tension. The pull-off, as accomplished, also positions the bobbin thread lead to the left of the sewing needle obviating half-hitching. Needle penetration of the work material occurs shortly after the pull-off of bobbin thread has taken place, the pull-off then making a second revolution, wherein no pull-off occurs due to the slack in the bobbin thread introduced in the prior revolution, but wherein retraction can occur by the shiftable element. This variable action is explained in more detail in U.S. application Ser. No. 055,847 filed July 9, 1979 of Ketterer, assigned to the assignee of the instant invention, copending herewith, and incorporated herein by reference and made a part of this application.

The bobbin thread replenishing mechanism, except as specifically pointed out hereafter, is similar to and represents a modification of the prior bobbin thread replenishing mechanism disclosed in the U.S. Pat. No. 3,693,566, Sept. 26, 1972 of Ketterer, assigned to the assignee of the instant invention, which is hereby incorporated by reference and made a part of this application. The above-cited patent may be referred to for disclosure of all of the bobbin thread replenishing mechanism not specifically discussed herein.

In the drawing, 20 denotes the bed of a sewing machine frame carrying a bushing 21 in which a bed shaft 22 is journalled. The bed 20 is formed with an upwardly open looptaker accommodating cavity 23 closed by a slide cover plate, not shown, and by a throat plate 25. Rotatable in a bushing 26 carried in the bed is a hollow looptaker shaft 27 which is attached, as by welding or the like, to the underside of a looptaker indicated generally at 28 which is disposed in the cavity 23.

Figure 1:
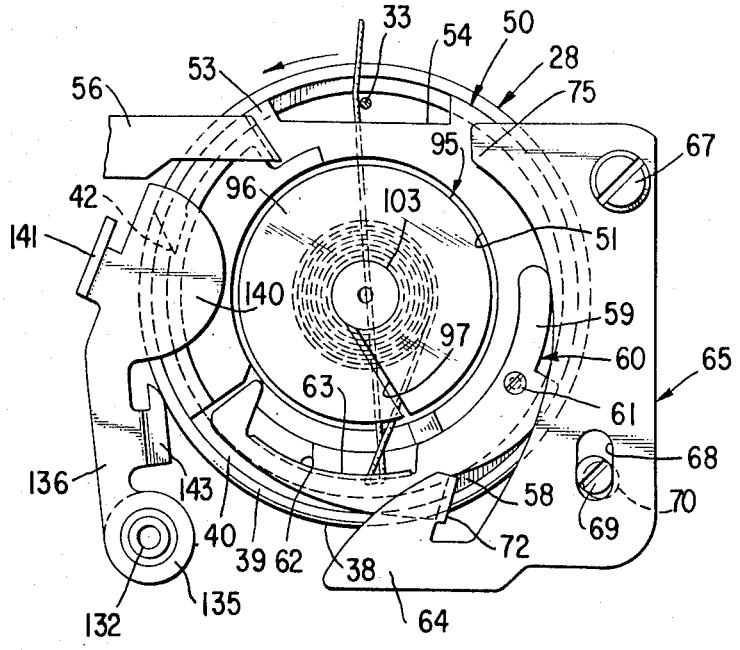
FIG. 1 is a top plan view of a sewing machine rotary looptaker together with mechanism for constraining a bobbin carrying bobbin case in place in the rotary looptaker.

The looptaker 28 disclosed in the drawing is a rotary hook which is imparted turning movement in a counterclockwise direction as indicated by the arrow in FIG. 1 during operation of the sewing machine by a bevel gear 29 made fast on the looptaker shaft by a set screw 30 and in mesh with a bevel gear 31 secured by a set screw 32 to the bed shaft 22. Preferably, the rotary hook partakes of two revolutions although three or more revolutions would be feasible during each cycle of endwise reciprocation of a needle 33 which cooperates therewith in the formation of stitches passing through a needle hole in the throat plate 25.

The rotary hook of this invention has an upwardly open cup-shaped form including a rim 38 having an upwardly extending bearing shoulder 39. The rim is also formed with an annular inwardly extending bearing rib 40 having a lateral opening 41 formed at one side with a needle thread loop seizing beak 42. The needle 33 reciprocates in a path which traverses the plane containing the path of circular movement of the loop seizing beak 42.

The cup-shaped rotary hook 28 includes a base 43 formed internally with an annular recess 44, a portion of which may extend completely through the hook base to provide clearance for the dip of the needle. The hook base 43 also has a central counterbore 45 within which there is seated a raised generally annular bobbin thread control cam 46 mounted to the hook base, generally surrounding the center of the base, as by a screw 47.

Constrained within the cup-shaped rotary hook is a bobbin case indicated generally at 50. The bobbin case is formed with an upwardly open bobbin accommodating cavity 51 through the bobbin of which a large central aperture 52 extends. Externally, the bobbin case is formed with a bearing flange 53 which rests upon the bearing rib 40 of the rotary hook and is constrained radially against the bearing shoulder 39. The bobbin case flange at one side is slabbed, as at 54, substantially along a chord to provide clearance for the path of needle reciprocation between the bobbin case and the rotary hook. Adjacent the slabbed portion 54 the bobbin case flange 53 is also formed with a shallow recess into which fits a rotation restraining element 56 secured to the machine bed 20. The bobbin case flange 53 substantially diametrically opposite the slabbed portion 54 is formed with a recess 58 on which a support arm 59 of a thread tensioning spring bracket 60 is secured by a fastening screw 61.

The bobbin case 50 adjacent the recess 58 in the flange 53 is formed with a radial opening 62 across which the thread tensioning spring bracket 60 spans. A downturned arm 63 on the bracket 60 is also disposed in the bobbin case radial opening 62 and provides a mounting surface against which a bobbin thread tensioning spring is secured.

Figure 2:
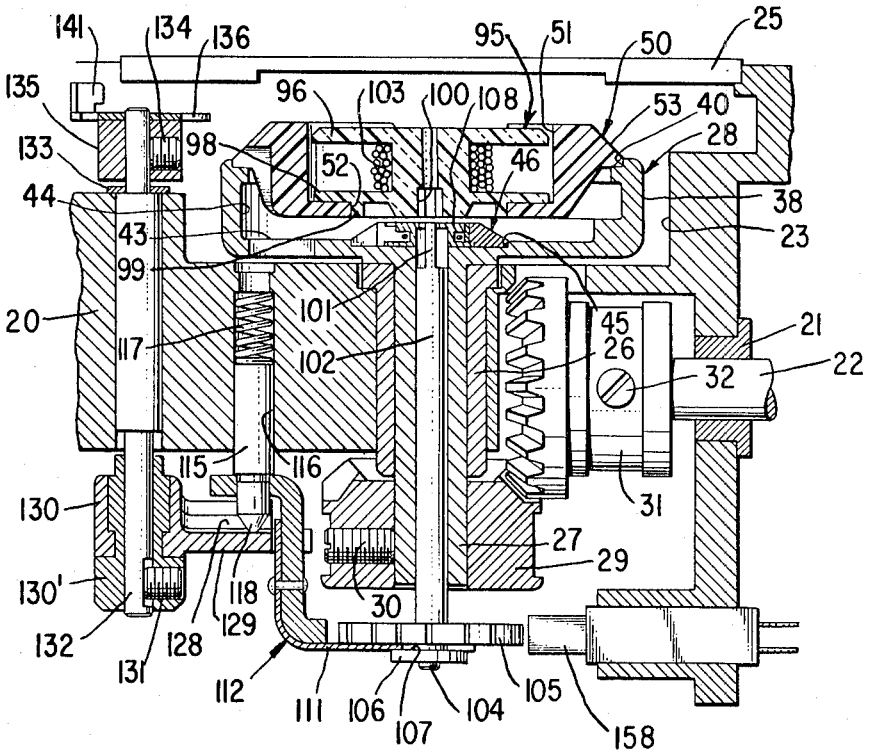
FIG. 2 is a cross sectional view of a sewing machine bed incorporating the rotary looptaker, bobbin case, and bobbin of FIG. 1, incorporating a variable pull-off and the modified bobbin winding apparatus of the present invention.

For additional restraint of the bobbin case an additional rotation restraining arm 64 extending from a base plate 65 is provided. The base plate 65 is formed with an aperture for a shouldered screw 67 threaded into the machine bed; and the base plate is formed with an elongated slot 68 to accommodate the eccentric head 69 of a locating pin 70 secured by a set screw in the machine bed. The rotation restraining arm 64 is formed with a downturned lip 72 which abuts a shouldered portion on the support arm 59 of the thread tensioning spring bracket 60. The base plate 65 is formed with another holddown arm 75 which extends over the bobbin case 50 adjacent the slabbed portion 54 of the bobbin case. For clarity, the rotation restraining element 56 and the plate 65 have been omitted from FIG. 2.

A central aperture 55 passes through the cam 46 and a major segmental portion of the periphery of the bobbin thread control cam 46 is chamfered as at 48 while an intervening portion 49 of the peripheral edge if formed substantially square. This raised bobbin thread control cam 46 serves a function in pulling off and positioning a bobbin thread during a first rotation of the looptaker during the sewing cycle as described in greater detail in my prior U.S. Pat. No. 3,693,565 issued Sept. 26, 1972, assigned to the assigned of the instant invention, which is hereby incorporated by reference and made a part of this application, and to which reference may be had while the variable element described hereafter is, as described in greater detail in my copending U.S. application Ser. No. 055,847 filed July 9, 1979 is more effective in retracting bobbin thread during the stitch setting process during a second rotation of the looptaker during the sewing cycle. The bobbin winding mechanism of the present invention is equally adaptable to either type of bobbin thread control, as well as to other rotary looptakers.

Freely rotatable in the bobbin accommodating cavity 51 of the bobbin case is a bobbin indicated generally at 95. The bobbin includes a top flange 96 formed with an outwardly extending slot 97 skewed slightly from a true radial position on the top flange. The bobbin is formed with a bottom flange 98 having a depending annular flange 99 which fits into the central aperture 52 of the bobbin case. The bobbin 95 is formed with a noncircular central aperture 100. As shown in the drawings, the aperture 100 may be flattened to match the flattened extremity 101 of a driving spindle 102 which is arranged in the hollow looptaker shaft for driving the bobbin when it is desired to replenish thread thereon. Between the flanges 96 and 98 of the bobbin a plain cylindrical hub 103 is provided.

The spindle 102 forms a part of the bobbin thread replenishing mechanism for selectively rotating the bobbin 95 to wind replenishment thread thereon as well as, in the illustrated embodiment, forming a part of the control mechanism for varying the bobbin thread retraction. The spindle 102, for control of the thread retraction near its lower extremity may be formed with a threaded portion 104 onto which a magnetic brake armature 105 is threaded and made fast. The armature 105 carries on its under surface a downwardly extending annular boss 106 formed with an annular groove 107. A slip clutch 108 provided with an elongated slot 109 is positioned around the flattened end portion 101 of the spindle 102 generally within the central aperture 55 of the control cam 46. The slip clutch 108 has an enlarged lower flange 110 which rests on the looptaker base 43 and rubs against the thread control cam 46 which, it will be recalled, is mounted to the looptaker 28. By this arrangement the spindle 102 will be driven with the looptaker by way of the friction coupling of the slip clutch 108 between the looptaker 28 and the thread control cam 46. Should sufficient resistance to the turning of the spindle 102 arise, as when the bobbin is full, the looptaker 28 and thread control cam 46 may turn freely relative the slip clutch 108. At this time, the control arm 136 would be turned counterclockwise by the operator to disengage the spindle 102 from the bobbin 95 and a driving relationship would be reinstated only when the control arm 136 is turned in a clockwise direction, which reinstates the driving relationship and forces any thread which is being carried by the loop seizing beak 42 of the looptaker 28 to be introduced to the bobbin thread tensioning spring and to be directed into the bobbin for replenishment of the bobbin thread supply.

When it is desired to replenish thread on the bobbin, it is merely necessary for the operator of the sewing machine to detain the free end of thread extending from the eye of the needle above the throat plate 25, and to shift the control arm 136 in a clockwise direction into a position extending over the bobbin 95. When the control arm is shifted in a clockwise direction the cam surface 128, acting upon the cam follower head 118 will elevate the spindle 102 causing the flattened end 101 of the spindle to enter in driving relationship with the mating noncircular aperture 100 in the bobbin. It is only necessary thereafter, for the operator of the machine to initiate the sewing machine drive to cause reciprocation of the needle and rotation of the looptaker 28 as if these parts were to be actuated in the formation of stitches.

On the first dip of the needle both limbs of the needle thread through the eye of the needle will depend downwardly through the needle aperture in the throat plate, and the looptaker beak 42 will seize this needle thread loop and as set forth in U.S. Pat. No. 3,693,566, this loop of needle thread will be introduced into the bobbin and cast loose from the looptaker beak. As the bobbin continues to turn with the looptaker, the limb of needle thread which enters the bobbin will be wrapped about the hub 103 of the bobbin. As wrapping of the thread begins the slack will be dissipated in the thread.

An abraiding action will sever the thread limb after just a few rotations of the bobbin after which the retained free end of the needle thread may be withdrawn and discarded. Thereafter, continued rotation of the bobbin will serve to wind thereon replenishment thread for later use as bobbin thread in the formation of lockstitches.

When sufficient thread has been wound on the bobbin, the bobbin thread replenishing operation may be terminated by shifting the control arm 136 counterclockwise back to the position of FIG. 1. The cam surface 128 will shift relative the cam follower head 118 allowing the spring 117 to lower the spindle 102 out of driving engagement with the bobbin. If work is inserted on the throat plate 25 beneath the path of needle reciprocation, subsequent operation of the needle and looptaker will result in the formation of lockstitches in a manner which is well known in the prior art.

In the illustrated embodiment, providing variable retraction from the setting stitch, a bobbin thread control lever spring 150 is provided associated with the bobbin thread control cam 46 but angularly adjustable relative thereto so that its timing relationship may be advanced or retarded to modify thereby the amount of retraction of bobbin thread during stitch setting. In order to accommodate the bobbin thread control lever spring 150, the bobbin thread control cam is provided with a segmental cut out 151 within which the bobbin thread control lever spring 150 may move. The bobbin thread control lever spring may comprise a generally arcuate mounting portion 152 frictionally mounted on the slip clutch 108 and inside the central aperture 55 of the thread control cam 46 so as to enable the bobbin thread control lever spring 150 to be rotated around the slip clutch 108 within an angular range determined by the sides or angularly separated edges of the segmental cut out 151. The thread control lever spring 150 also comprises, at its outboard end, a thread control portion 153 adapted to contact the bobbin thread as the looptaker rotates for the second time in the stitch formation cycle providing the bobbin thread retraction action as the stitch is set by the needle thread take-up, the time of contact being variable as detailed in other places herein to effectively vary the amount of retraction to provide an effective equivalent to variation in the amount of pull-off. To provide for angular movement of the thread control lever spring in one direction with the segmental cut out 151, a generally arcuate return spring 154 may be provided adjacent the arcuate portion 152 of the bobbin thread control lever spring 150 having a first tang portion 155 engaged in an aperture 156 in the thread control cam 46 and a second tang portion 157 engaging the bobbin thread control lever spring 150 thereby biasing the bobbin thread control lever spring in the direction of rotation of the looptaker 28 defining an advanced position or timing thereof providing maximum retraction for use in straight stitch sewing where less thread is used for each stitch than in an equivalent number of stitches per inch in a zig zag mode.

As pointed out above, the bottom of the spindle 102 is provided with a magnetic brake armature 105. There may be also provided, adjacent the brake armature 105, an electric brake coil 158 which, when energized, applies a drag force on the brake armature 105. This in turn, applies a brake force to the spindle 102 and the slip clutch 108. The slip clutch 108 then applies a frictional brake force to the arcuate portion 152 of the bobbin thread control lever spring 150, against the force of the return spring 154 as the looptaker 28 rotates, retarding the position and, therefore, the timing of the engagement of the thread engaging portion 153 with the limb of the bobbin thread extending to the stitch being set and, since at such a later time in the machine cycle the needle thread takeup has pulled more bobbin thread up toward or into the setting stitch, the control lever spring cannot retract as much bobbin thread from the setting stitch but, rather, if it demands additional thread it pulls such additional thread from the bobbin, merely providing some additional slack to be available for the next stitch. Hence, without having to adjust the needle thread tension, which would affect the effect of the stitches on the material being sewn, varying amounts of bobbin thread are provided to the stitch as set and the interengagement of the needle and bobbin thread as the stitch is set occurs closely to the desired location within the layers of material being sewn regardless of whether the amount of thread required per stitch is long, as in zig zag stitching or shorter, as in straight stitching. Obviously, this arrangement could also be used to improve stitch formation if an exceptionally wide range of straight stitch length were desired.

For the wind cycle the bobbin drive spindle 102 is raised by the bobbin driver spring 112. The slip clutch 108 allows the control lever spring 150 to rotate to the zig zag position and then the slip clutch will rotate with the looptaker 28 until the bobbin thread stops the rotation of the bobbin by contact with the inside diameter of the bobbin cavity 51 in the bobbin case 50. At this point the slip clutch 108 will allow the bobbin driver spindle 102 to stop while the looptaker 28 continues to rotate, thus preventing a machine jam or damaged bobbin case.

It is also evident that the invention will find utility in lockstitch looptakers other than that described, such as, for example, horizontal axis looptakers or inclined axis looptakers, as well as in, for example, machines utilizing a completely fixed bobbin thread control cam without variable retraction.

I claim:

1. In a lockstitch forming sewing machine having a looptaker comprising a circularly moving looptaker body formed with an annular raceway for accommodating a bobbin case constrained against motion with said looptaker, a bobbin winding mechanism for winding thereon the bobbin from the needle comprising a slip clutch carried by the looptaker body and means for rotating the bobbin for winding needle thread thereon comprising an elevatable spindle passable through said slip clutch and engageable with the bobbin for rotating the bobbin for rotation with said looptaker body while said slip clutch enables cessation of bobbin rotation when the bobbin is full and bobbin thread winding is no longer required.

2. Sewing machine defined in claim 1 wherein there is provided thread guiding means for directing a bobbin thread from said bobbin between said stationary bobbin case and said circularly moving looptaker body, and said looptaker body is provided with a bobbin thread pull-off cam beneath said bobbin case and said slip clutch is mounted between said looptaker body and said bobbin thread pull-off cam.

3. Sewing machine defined in claim 2 wherein said slip clutch is provided with a noncircular central aperture and the mating end portion of said spindle is also noncircular so as to be nonrotatable therein, said spindle being slidable therethrough for selectively winding bobbin thread for replenishing the bobbin supply.

* * * * *